US007766266B2

(12) United States Patent
Huang

(10) Patent No.: US 7,766,266 B2
(45) Date of Patent: Aug. 3, 2010

(54) SOUND GENERATOR HELP SYSTEM OF SHREDDER

(75) Inventor: William Huang, SanChung (TW)

(73) Assignee: Michilin Prosperity Co., Ltd. (TW)

( * ) Notice: Subject to any disclaimer, the term of this patent is extended or adjusted under 35 U.S.C. 154(b) by 152 days.

(21) Appl. No.: 11/980,920

(22) Filed: Oct. 31, 2007

(65) Prior Publication Data

US 2008/0296830 A1 Dec. 4, 2008

(30) Foreign Application Priority Data

May 31, 2007 (CN) ..... 2007 2 0147485 U

(51) Int. Cl.
*B02C 25/00* (2006.01)

(52) U.S. Cl. ..... 241/101.3; 241/100

(58) Field of Classification Search ..... 241/100, 241/236, 101.02, 101.3, 37.5
See application file for complete search history.

(56) References Cited

U.S. PATENT DOCUMENTS

| | | | | |
|---|---|---|---|---|
| 6,965,294 | B1 * | 11/2005 | Elliott et al. | 340/5.2 |
| 7,303,158 | B1 * | 12/2007 | Abramson et al. | 241/30 |
| 7,673,822 | B2 * | 3/2010 | Abramson et al. | 241/30 |
| 2007/0300031 | A1 * | 12/2007 | Jevans et al. | 711/166 |
| 2008/0111685 | A1 * | 5/2008 | Olson et al. | 340/545.6 |

* cited by examiner

*Primary Examiner*—Mark Rosenbaum
(74) *Attorney, Agent, or Firm*—Venable LLP; Stefan J. Kirchanski

(57) ABSTRACT

A sound generator help system of a shredder is disclosed. A disorder signal during the operation of the shredder is transmitted to the sound generator help system which then suggests the user how to correct operate the shredder and fix the problem in voice. When a problem occurs, the system flashes light to notify the user. By making a switch, the user can determine whether to play voices of the suggestion.

2 Claims, 1 Drawing Sheet

SOUND GENERATOR HELP SYSTEM OF SHREDDER

CLAIM OF PRIORITY

This application claims priority to Foreign Application No. 200720147485.2 filed in P.R. China, on May 31, 2007.

BACKGROUND OF THE INVENTION

1. Field of Invention

The invention relates to a shredder and, in particular, to a sound generator help system. When a problem occurs, a light immediately flashes to notify the user. The user can then activate a sound generator which gives verbal instructions to solve the problem.

2. Related Art

To prevent such documents as legal files, receipts, invoices, credit card numbers, research reports, or personal financial information (e.g., credit card and phone bills) from being released, it is common to destroy them using a shredder. Therefore, the shredder has become an indispensable device for both business and home.

During operation, the user may damage the shredder because he/she does not know how to correctly operate the machine. In addition, it is sometimes difficult to follow the instructions in order to solve a problem with the shredder. Some common examples include the following:

1. The number of paper sheets exceeds the sheet capacity of the machine leading to a paper jam.

2. The shredder is overloaded from continuous long-time use resulting in high temperatures and overheating.

3. The shredder is not properly disposed on the top opening of the trash bin, so that the interlock safety switch is not activated and the shredder does not turn on. The user often mistakes this as a problem with the shredder.

4. The trash bin is full, yet the user continues to shred material. This further shredding causes a paper jam because previously shredded paper pieces are fed back up into the blades where they become stuck.

Some shredders are capable of automatically shutting down the power when the trash bin is full, when there is a paper jam, or when the shredder is separated from the trash bin. When these situations occur, they may use an alerting light or buzzer to notify the users. This disclosed invention furthers the quest for more consumer friendly products by providing verbal instructions to solve common shredder problems.

SUMMARY OF THE INVENTION

The disclosed invention provides a shredder sound generator help system. When a problem occurs, the system immediately notifies the user with a flashing light. By activating a switch, the user can then receive verbal instructions on how to solve the problem.

To achieve the above objective, the disclosed shredder sound generator help system sends the problem signal to the sound generator help system for a determination. The system then plays a related suggestion to solve the problem.

In particular, the paper path detector, forward and reverse controller, motor control device, safety switch detector, bin full detector, motor overload detector, and motor temperature detector transmit a problem signal to the sound generator help system for processing. When an issue arises, a light is flashed to notify the user. When a switch is activated, the user can determine whether to play voices of the related suggestion.

BRIEF DESCRIPTION OF THE DRAWINGS

The invention will become more fully understood from the detailed description given herein below. The following drawings are for illustration only, and thus should not limit the scope of the present invention.

DETAILED DESCRIPTION OF THE INVENTION

Figure 1:
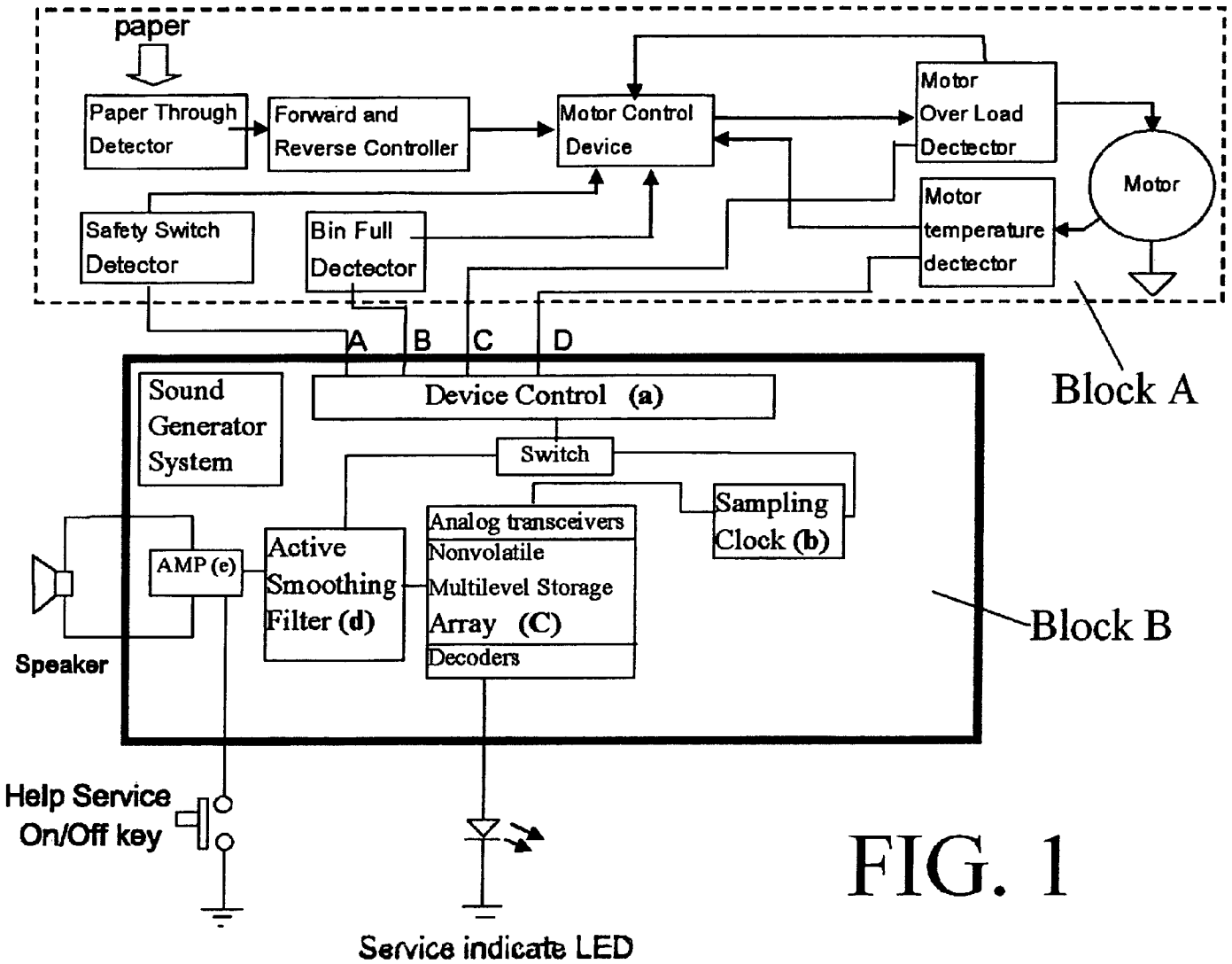
FIG. 1 is a block diagram of the processing system for an apparatus embodying features of this invention.

The present invention will be apparent from the following detailed description, which proceeds with reference to the accompanying drawings, wherein the same references relate to the same elements.

Please refer to the system processing block diagram in FIG. 1. Block A discloses the functions of the existing shredder, including a paper path detector, a forward and reverse controller, a motor control device, a safety switch detector, a bin full detector, a motor overload detector, and a motor temperature detector. Block B discloses the sound generator help system.

When the safety interlock switch does not have good contact with the bin, the safety switch detector is activated (path A). When the trash bin is full, the bin full detector is activated (path B). When the shredder motor is overloaded, the motor overload detector is activated (path C). When the temperature of the shredder motor is too high, the motor temperature detector is activated (path D). These detectors transmit an analog signal to a device control (a). The device control then automatically scans the input signal to identify the type of problem and to start a corresponding voice output. The analog signal is first converted into a digital signal by passing through a sampling clock (b) and an analog transceivers non-volatile multilevel storage array (c). The digital signal is compressed and stored into memory. In addition, a light is flashed to notify the user. The digital signal is further converted into a linear signal before its output. The saw wave generated during the conversion process is filtered by an active smoothing filter (d). Finally, the voice is amplified by an amplifier (e).

When any of the above-mentioned problems occur, the system flashes a service indicate LED to notify the user. If the user wants a voice suggestion to assist in solving the problem, the user can push a help service key to get verbal assistance with instructions to solve the problem.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A sound generator help system for a paper shredder comprising:

an indicator light that notifies a user when there is a problem with the shredder;

a device control which identifies the type of problem and sends a signal corresponding to the type of problem which is processed and stored into memory, a key that a user can depress in order to get audible instructions on how to solve the problem, and a speaker through which the audible instructions are emitted.

2. The sound generator help system for a paper shredder of claim 1, wherein the indicator light notifies a user of a type of problem selected from the group consisting of a paper path detector, a forward and reverse controller, a motor control device, a safety switch detector, a bin full detector, a motor overload detector, and a motor temperature detector.

* * * * *